US008005396B2

(12) United States Patent
Ohanyan et al.

(10) Patent No.: US 8,005,396 B2
(45) Date of Patent: Aug. 23, 2011

(54) METHODS AND APPARATUS FOR REMANUFACTURING TONER CARTRIDGES

(75) Inventors: Tigran Ohanyan, Burbank, CA (US); Denny Holmes, Los Angeles, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 907 days.

(21) Appl. No.: 11/893,840

(22) Filed: Aug. 17, 2007

(65) Prior Publication Data

US 2009/0047035 A1 Feb. 19, 2009

(51) Int. Cl.
*G03G 15/00* (2006.01)

(52) U.S. Cl. ..... 399/109; 269/257; 269/295; 408/3

(58) Field of Classification Search ..... 399/109; 269/37, 43, 295, 257; 408/3
See application file for complete search history.

(56) References Cited

U.S. PATENT DOCUMENTS

| | | | | | |
|---|---|---|---|---|---|
| 1,890,114 | A * | 12/1932 | Fulton | 269/282 |
| 3,675,916 | A * | 7/1972 | Kartasuk et al. | 269/69 |
| 4,418,901 | A * | 12/1983 | Woods et al. | 269/71 |
| 4,573,669 | A * | 3/1986 | Gerry | 269/271 |
| 4,669,926 | A * | 6/1987 | Wilcox, Jr. | 408/1 R |
| 4,865,496 | A * | 9/1989 | Challis | 408/115 R |
| 5,697,933 | A * | 12/1997 | Gundlapalli et al. | 606/96 |
| 5,800,099 | A * | 9/1998 | Cooper | 408/1 R |
| 6,152,435 | A * | 11/2000 | Snell | 269/43 |
| 6,206,060 | B1 * | 3/2001 | Blake | 144/87 |
| 2003/0170045 | A1 * | 9/2003 | Lewis et al. | 399/109 |
| 2006/0120753 | A1 * | 6/2006 | Moore et al. | 399/109 |

* cited by examiner

*Primary Examiner* — David Gray
*Assistant Examiner* — G. M. Hyder

(57) ABSTRACT

A device for supporting printer cartridge re-manufacturing work, the device comprising at least one printer cartridge mount, the mount comprising an abutting portion configured to abut to a portion of a printer cartridge cylinder positioned on the mount, the device further comprising a drill hole template connected to the printer cartridge mount, the drill hole template defining a drill hole configured to accommodate a cutting device and to create a printer cartridge cutting pattern for the cutting device.

18 Claims, 6 Drawing Sheets

METHODS AND APPARATUS FOR REMANUFACTURING TONER CARTRIDGES

CROSS REFERENCES TO RELATED APPLICATIONS

None

FIELD OF INVENTION

The present invention relates to electrophotography, particularly methods and apparatus for remanufacturing toner cartridges.

BACKGROUND

Used printer cartridges of fax machines, copiers, inkjet printers, and laser printers are often remanufactured. The remanufacturing of printer cartridges may include cleaning, repairing damaged parts, and replacing worn parts. The remanufacturing process may also include refilling the toner hopper with toner. Toner may be introduced into the toner hopper by drilling a hole, refilling the toner, and then covering the hole. Typically, these steps are executed by hand and a drill.

At least one problem with the conventional technique is that the toner hopper is not secured throughout the process. The toner hopper may move during the drilling or the refilling steps, which may add to the time it takes to complete the refilling process. This additional time is undesirable in a high volume re-manufacturing environment. The conventional technique may also expose the toner agitators from coming into contact with the cutting device used. These problems may add toner refilling time and hassles, which is undesirable in a high volume re-manufacturing environment. Methods and apparatus for effectively refilling the cartridge with toner are desired and are addressed by the present invention.

BRIEF DESCRIPTION

A device for supporting printer cartridge re-manufacturing work, the device comprising at least one printer cartridge mount, the mount comprising an abutting portion configured to abut to a portion of a printer cartridge cylinder positioned on the mount, the device further comprising a drill hole template connected to the printer cartridge mount, the drill hole template defining a drill hole configured to accommodate a cutting device and to create a printer cartridge cutting pattern for the cutting device.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Figure 1:
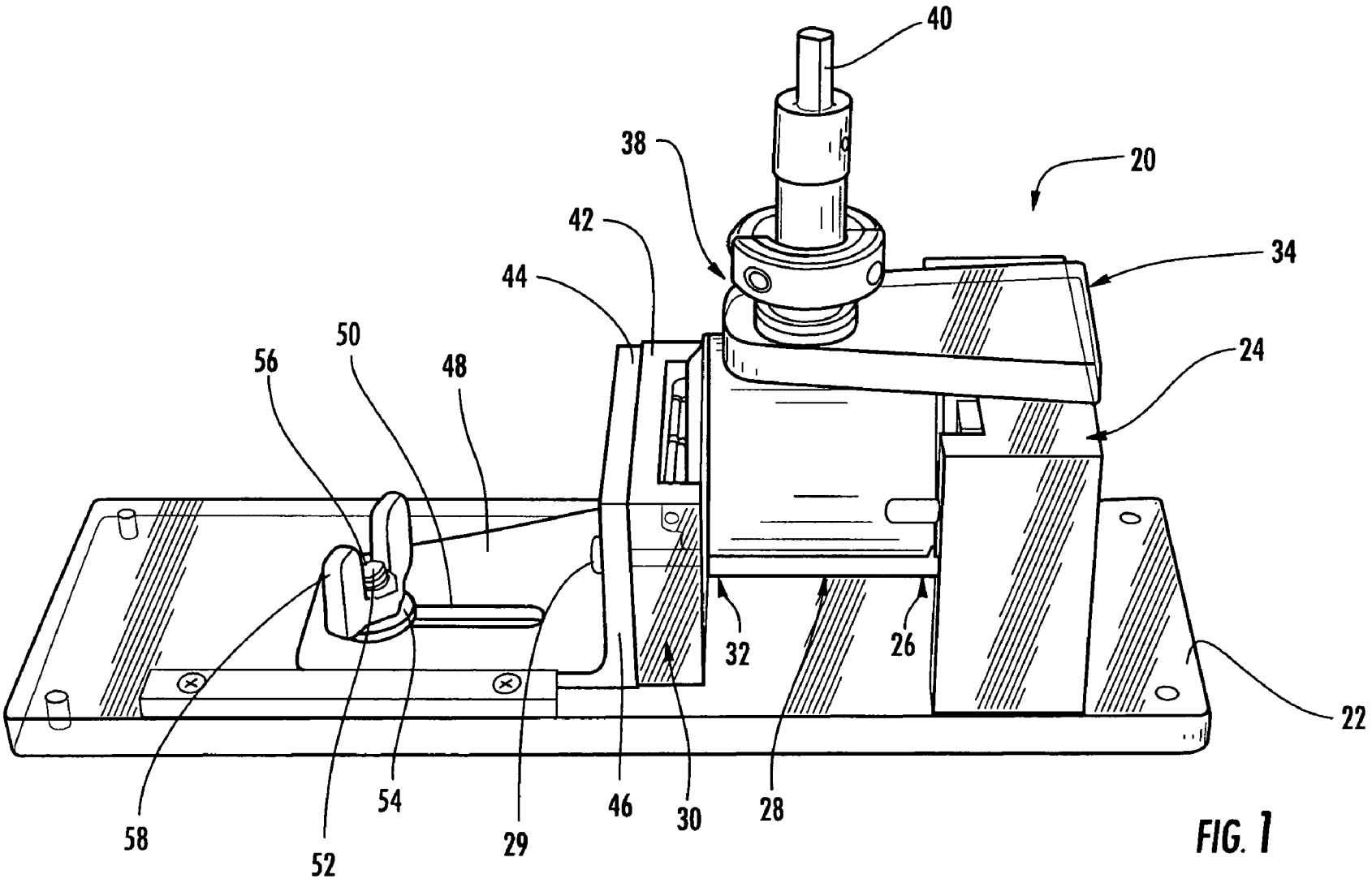
FIG. 1 is substantially a front view of an embodiment of the fixture device of the present invention.

The present invention comprises various embodiments of a fixture device for supporting work on a printer cartridge and related methods of use. Referring to FIG. 1, the fixture device 20 preferably includes a base 22, a first mount 24 that is configured to serve as a mount for a first end 26 of a printer cartridge 28, a second mount 30 that is configured to serve as a mount for a second end 32 of the printer cartridge 28. The base 22 may be a piece of material known in the art, such as acrylic, wood, or metal.

The second mount 30 preferably includes a wall 42 preferably positioned substantially perpendicular to the base 22. The wall 42 is preferably configured to directly contact and hold the printer cartridge 28. The second mount 30 preferably also includes a frame 44, which is preferably substantially L-shaped and is attached to the side of the wall 42 that is opposite to the side that directly contacts the printer cartridge 28. The frame 44 is preferably attached to the wall 42 using fasteners 29 known in the art. The frame 44 preferably defines a first plane 46 having an axis that is substantially parallel to the wall 42 and a second plane 48 having an axis that is substantially parallel to the base 22.

The second plane 48 of the frame 44 preferably defines a substantially lateral recess 50. A screw 52 preferably runs through the base 22 and protrudes through the lateral recess 50. A washer 54 may be positioned in between the screw end 56 and the second plane 48. A wing nut 58 may also be positioned in between the screw end 56 and the washer 54. Other fasteners known in the art may be used in lieu of the screw 52, washer 54, and the wing nut 58. It can be appreciated that by loosening the wing nut 58, the frame 44 and the wall 42 of the second mount 30 are allowed to slide. It can be appreciated that the movement of the second mount 30 relative to the base 22 is controlled by the position of the screw 52 within the lateral recess 50. The second mount 30 can be moved toward or away from the first mount 24 to accommodate varying sizes of printer cartridges.

Figure 2:
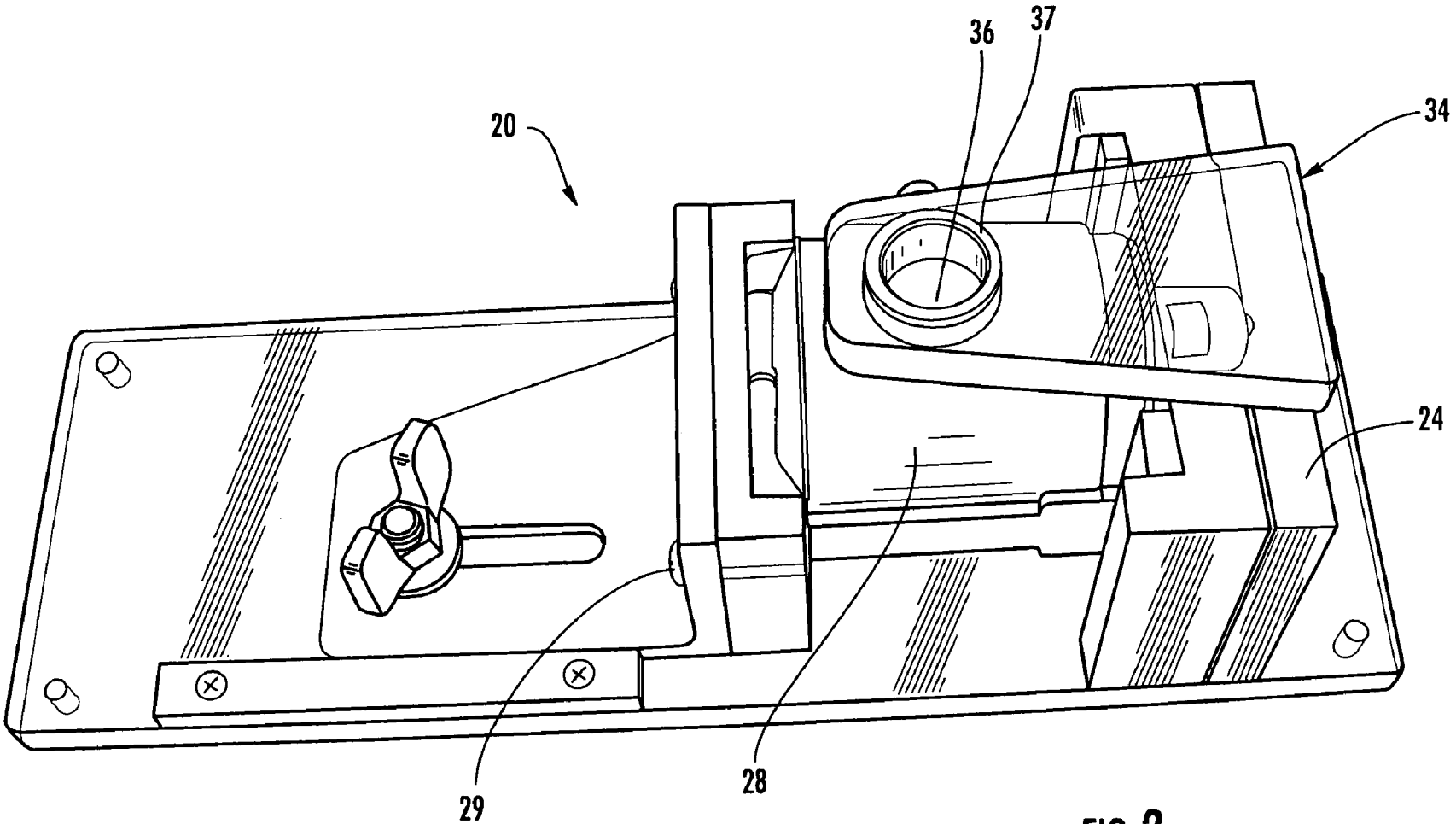
FIG. 2 is substantially a top plan view of the fixture device of FIG. 1 without the hole saw.

Referring now to FIG. 2, the fixture device 20 preferably also includes a drill hole template 34, which may be attached to the first mount 24 and may overhang from the first mount 24. The drill hole template 34 may be attached to other positions around the device fixture 20. The drill hole template 34 preferably defines a recess 36, which provides a cutting pattern for cutting a portion of the printer cartridge 28. The drill hole template recess 36 is preferably shaped to accommodate a hole saw 38 (FIG. 1), which may include a drill end 40 (FIG. 1). The drill end 40 may be attached to an electric drill that may be used to drive the hole saw 38 through the printer cartridge 28. A removeable collar 37 of a predefined height and internal diameter may be inserted in the drill hole template recess 36. The collar 37 may function to control the depth of the cut of the hole saw. Controlling the depth of the cut of the hole saw may prevent the hole saw from damaging internal components of the printer cartridge. A plurality of collars of varying heights and internal diameters may be provided to allow the fixture device to be used with various types and sizes of printer cartridges.

Figure 3:
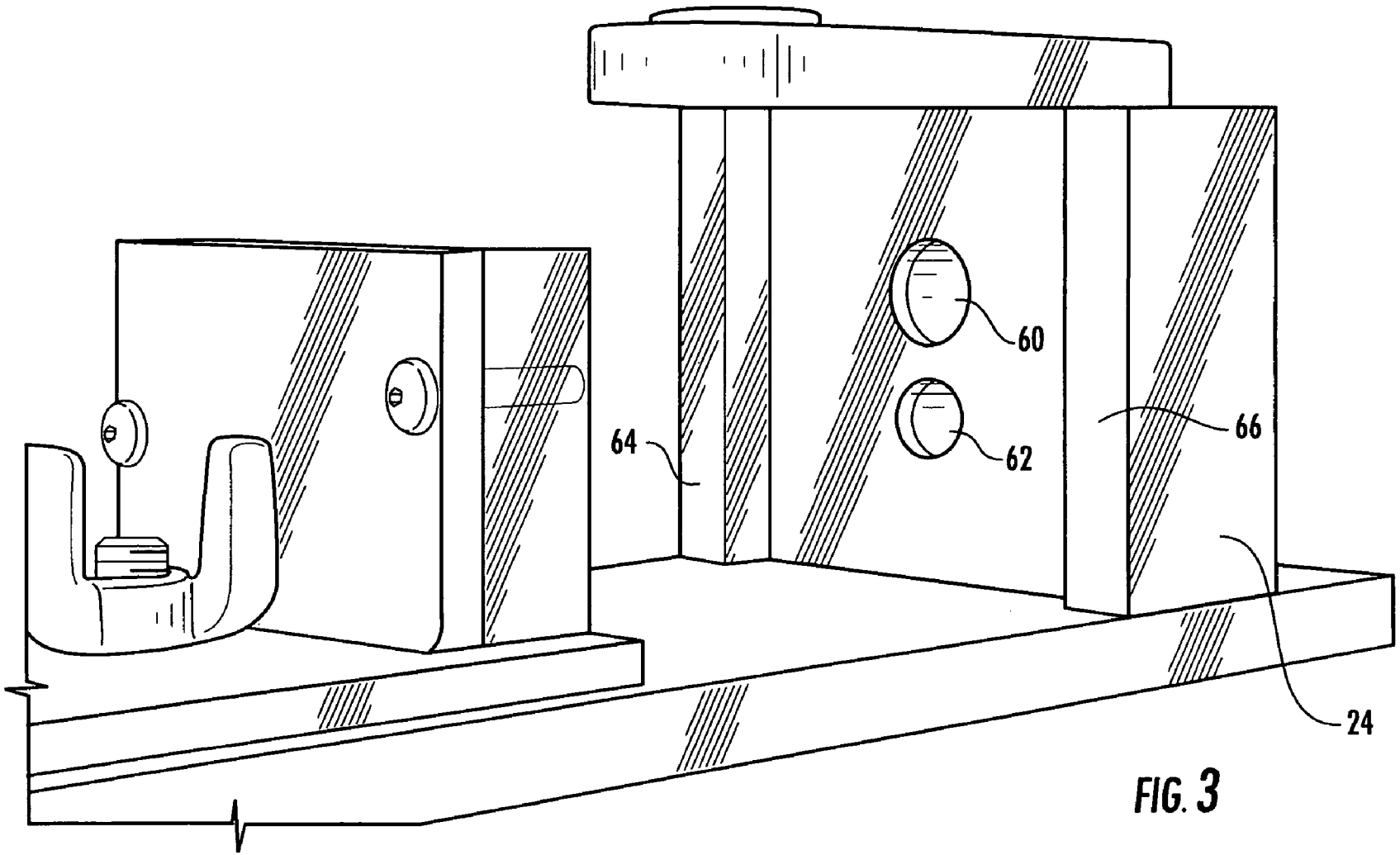
FIG. 3 is substantially a perspective view of the first mount of the fixture device shown in FIG. 1.

With reference now to FIG. 3, the first mount 24 of the fixture device 20 preferably defines one or more recesses 60 and 62 to accommodate protruding parts of the printer cartridge 28. First mount 24 preferably serves to support the printer cartridge 28 by supporting the protruding part of the printer cartridge 28 that is inserted through the recess 60 or 62. Protruding parts of the printer cartridge 28 may include toner agitator shafts (not shown). First wall 24 may further include side enclosures 64 and 66, which may be a pair of vertical structures attached to each side of the first mount 24. The side enclosures 64 and 66 may be perpendicularly attached to the first mount to create individual corners with the first mount 24. It can be appreciated that the side enclosures 64 and 66 may serve to further minimize movements of the printer cartridge 28 during work.

Figure 4:
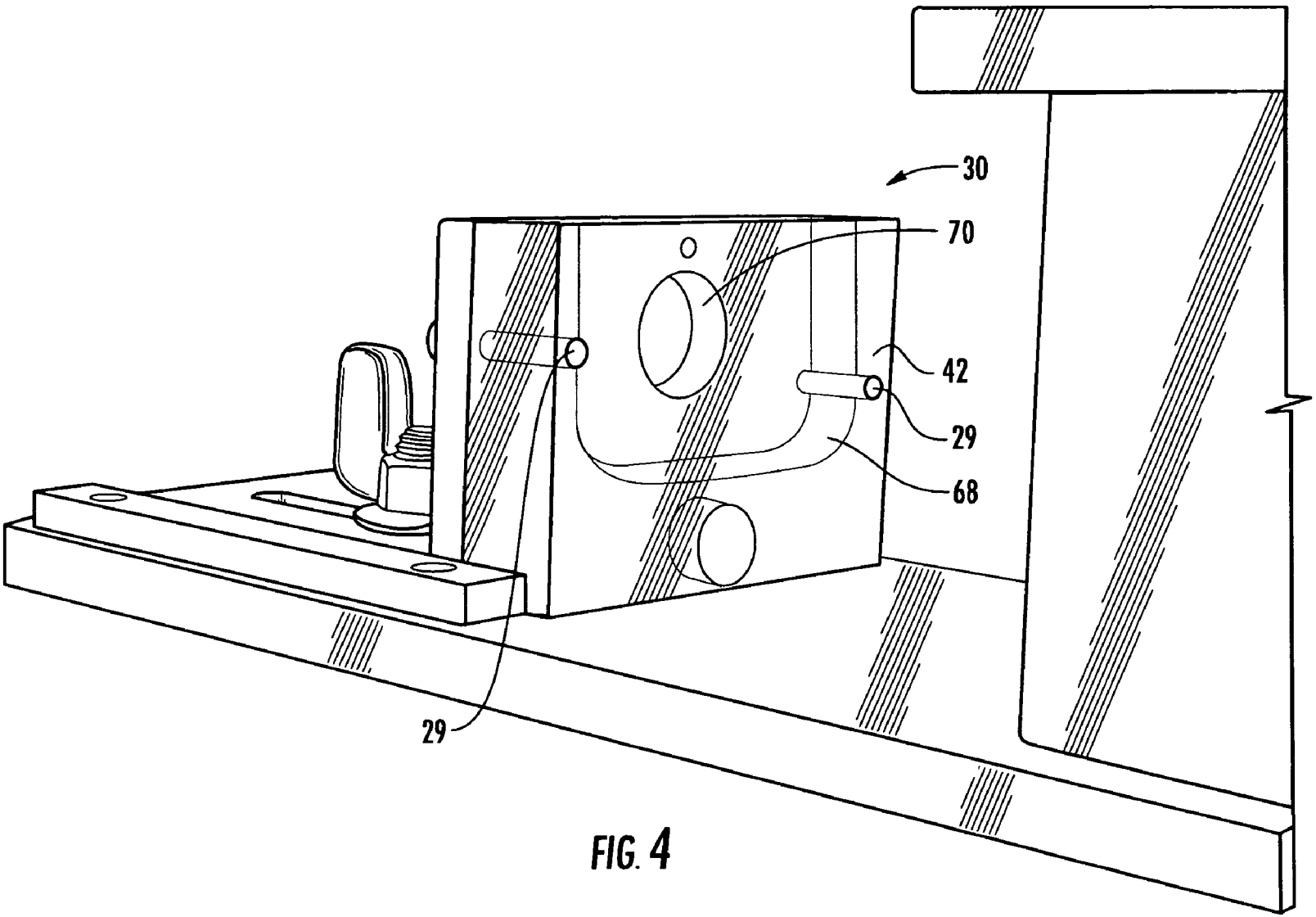
FIG. 4 is substantially a perspective view of the second mount of the fixture device shown in FIG. 1.

Referring now to FIG. 4, the wall 42 of the second mount 30 preferably defines a recess 70 configured to accommodate any protrusions of the printer cartridge 28 that may be attached to the second end 32 of the printer cartridge 28. The wall 42 of the second mount 30 also preferably defines saddle 68. The saddle 68 is preferably substantially U-shaped and is preferably configured to hold a cylindrically shaped printer cartridge. The U-shaped surface of the saddle 68 is configured to abut to a portion of the printer cartridge cylinder. It can be appreciated that a cylindrically shaped printer cartridge may roll when laterally positioned on a surface. With the saddle 68 of the fixture device 20 of the present invention, rolling movement of the printer cartridge during re-manufacturing is substantially minimized.

Figure 5:
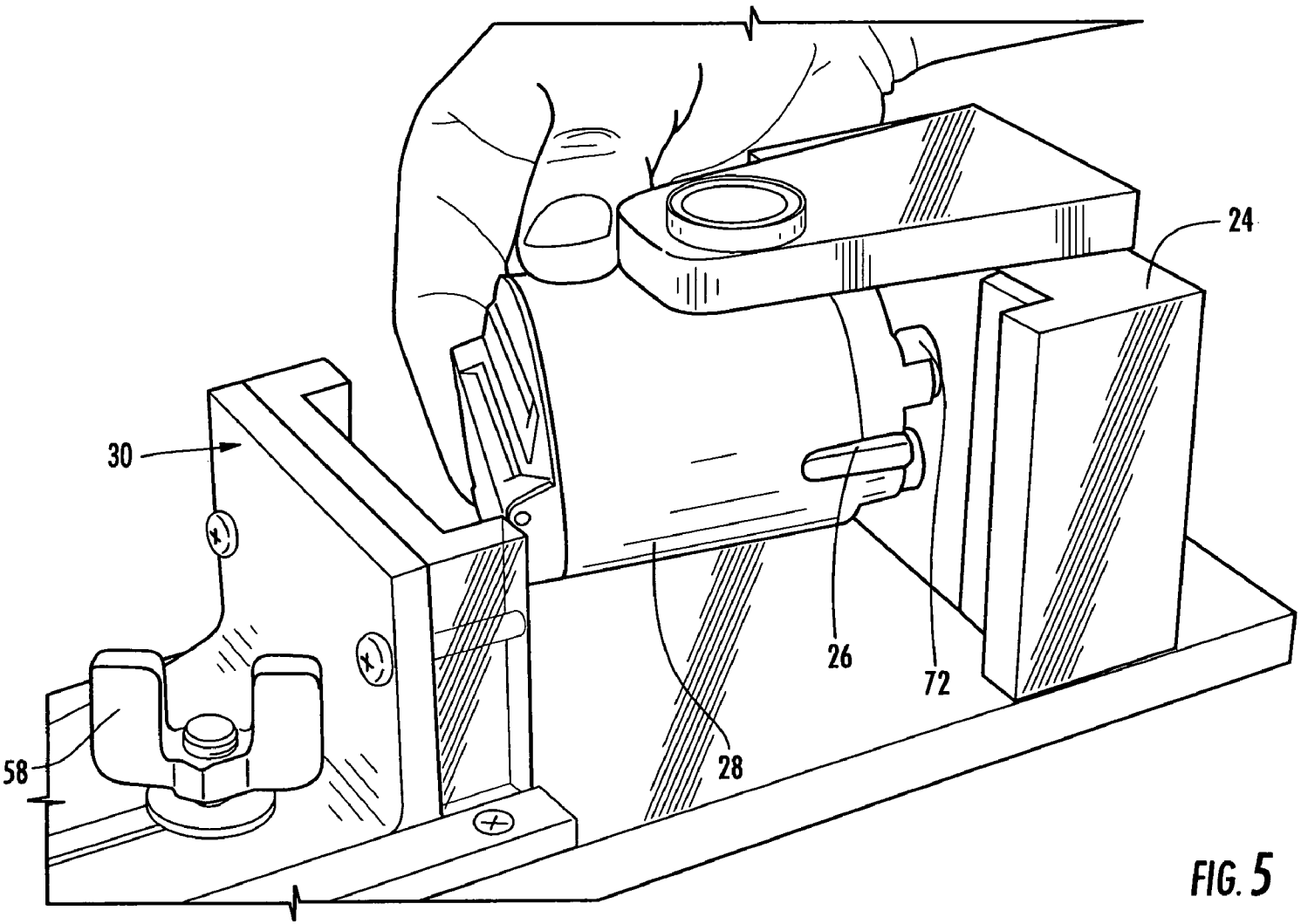
FIG. 5 is substantially a perspective view showing a printer cartridge being positioned on the fixture device.

Referring now to FIG. 5, the fixture device 20 may be used by loosening the wing nut 58 to allow the second mount 30 to slide away from the first mount 24 to provide room for the printer cartridge 28. The printer cartridge 28 may then be introduced in between the first mount 24 and the second mount 30. The printer cartridge 28 may be oriented in a manner that would allow printer cartridge protrusion 72 at the first end 26 to enter through the recess 60 defined by the first mount 24. The second mount 30 may then be moved closer to the first mount 24 until the saddle 68 abuts to and supports a cylindrical portion of the printer cartridge 28. The wing nut 58 may then be tightened to secure the printer cartridge 28 within the fixture device 20.

Figure 6:
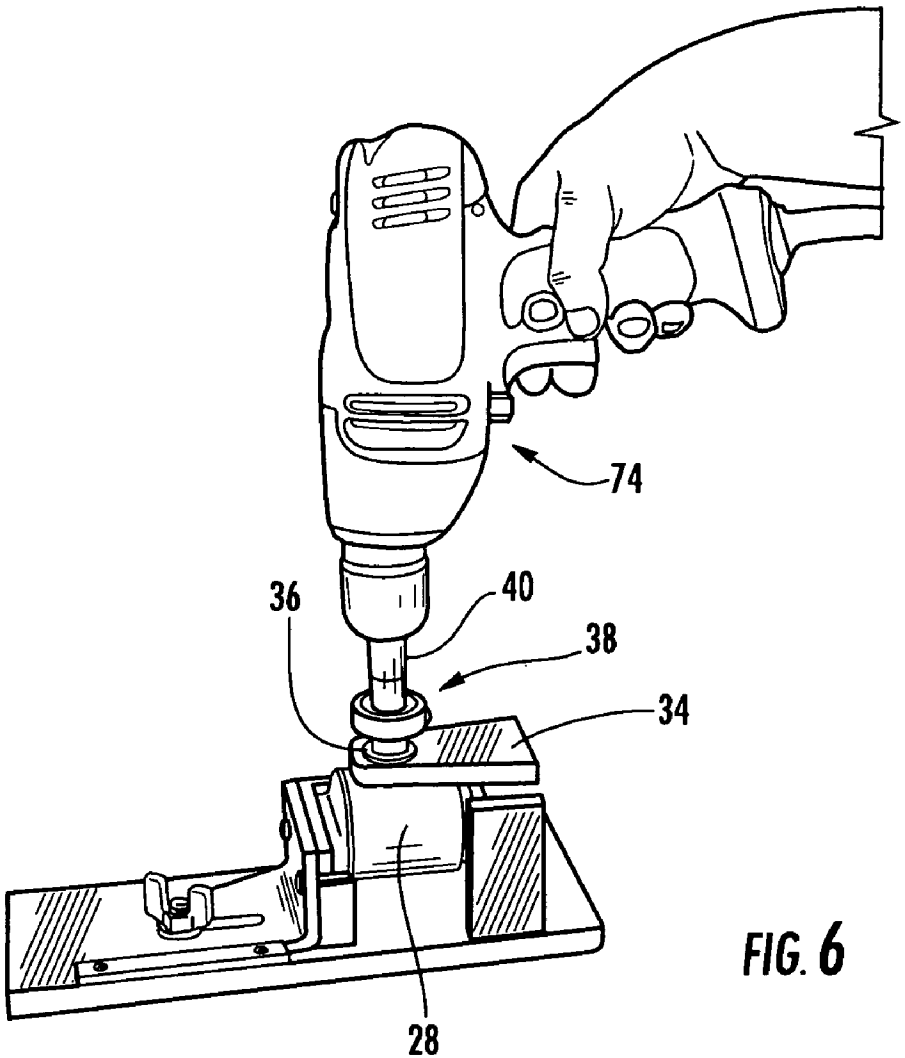
FIG. 6 is substantially a front view showing an electric drill being used to drill a hole on the printer cartridge that is positioned on the fixture device.

Referring now to FIG. 6, the hole saw 38 may then be positioned inside the drill hole 36 that is defined by the drill hole template 34. An electric drill 74 may then be attached to the drill end 40 of the hole saw 38. The electric drill 74 may be activated to cut the printer cartridge 28 according to a pattern created by the drill hole template 34. After the printer cartridge hole has been created, the printer cartridge may be filled with toner and then covered.

It can now be realized that the present invention provides a device that may effectively hold a cartridge portion or an entire cartridge during assembly, toner refill, remanufacture, refurbishment, repair, or maintenance. As a result, a cartridge re-manufacturer may be able to work efficiently and quickly. Finally, the present invention provides a template for creating a refill hole on a toner hopper, which may allow for an efficient toner refill procedure and may prevent damage to the internal parts of the printer cartridge, such as the agitator.

Although the description above contains many specifications, these should not be construed as limiting the scope of the invention but as merely providing illustrations of some of the presently preferred embodiments of this invention. For example, the shape of the base fixture may vary. The invention is capable of other embodiments and of being practiced and carried out in various ways. The invention is not limited in its application to the details of the construction and to the arrangement of the components set forth in the above description or as illustrated in the drawings.

What is claimed is:

1. A fixture device for supporting a printer cartridge during remanufacture of the printer cartridge, the fixture device comprising:

a. a one piece base;

b. a fixed first mount attached to the base, the first mount being configured to hold a first end of a the printer cartridge;

c. a movable second mount attached to the base and positioned opposite to the first mount, the second mount having a wall with a U-shaped saddle that is configured to directly contact and hold a second end of the printer cartridge, the first end and the second end of the printer cartridge being positioned opposite each other, wherein the second mount further has an L-shaped frame attached to the wall, the frame having a first plane parallel to the wall and a second plane parallel to the base, the second plane defining a lateral recess, the base and the second mount being attached by a fastener, the fastener passing through the lateral recess of the second plane and through the base, the lateral recess being configured to allow the second mount to move relative to the base and the fastener being configured to control the movement of the second mount; and d. a drill hole template attached perpendicular to the first mount, the drill hole template being positioned parallel to the base, the drill hole template defining a drill hole configured to accommodate a cutting device and to create a printer cartridge cutting pattern for the cutting device such that the printer cartridge can be filled with toner.

2. The device of claim 1, wherein the second end of the printer cartridge comprises a cylindrical shape, the cylindrical shape of the second end of the printer cartridge being configured to abut to the saddle to minimize rolling movement of the printer cartridge during remanufacturing.

3. The device of claim 1, wherein the second mount can be moved toward or away from the first mount to accommodate varying sizes of printer cartridges.

4. The device of claim 1, wherein the first mount defines at least one cartridge part receiving recess.

5. The device of claim 1, wherein the second mount defines at least one cartridge part receiving recess.

6. The device of claim 1, further comprising a hole saw configured to be inserted through the drill hole.

7. The device of claim 1, wherein the first mount is fixably attached to the base.

8. A fixture device for supporting a printer cartridge during remanufacture of the printer cartridge, the fixture device comprising:

a. a one piece base;

b. a fixed first support means for supporting a first end of a the printer cartridge, the first support means attached to the base;

c. a movable second support means having a wall with a U-shaped saddle that is configured for directly contacting and supporting a second end of the printer cartridge, the second support means being positioned opposite to the first support means, wherein the second support means further has an L-shaped frame attached to the wall, the frame having a first plane parallel to the wall and a second plane parallel to the base, the second plane defining a lateral recess, the base and the second support means being attached by a fastener, the fastener passing through the lateral recess of the second plane and through the base, the recess being configured to allow the second support means to move relative to the base and the fastener being configured to control the movement of the second support means; and d. a template means for providing a cutting pattern to the printer cartridge such that the printer cartridge can be filled with toner, the template means being attached to the first support means, the template means being positioned parallel to the base.

9. The device of claim 8, further comprising a cutting means for cutting through the printer cartridge supported by the first and second support means, the cutting means being configured to use the template means.

10. The device of claim 8, wherein the second support means can be moved toward or away from the first support means to accommodate varying sizes of printer cartridges.

11. The device of claim 8, wherein the second end of the printer cartridge abuts to the saddle to minimize rolling movement of the printer cartridge during remanufacturing.

12. The device of claim 8, wherein the second support means further comprises a receiving means for receiving a printer cartridge part.

13. The device of claim 8, wherein the first support means further comprises a receiving means for receiving a printer cartridge part.

14. A fixture device for supporting printer cartridge remanufacturing work, the fixture device comprising:

a. a one piece base;

b. a fixed first printer cartridge mount connected to the base, the first mount being configured to hold a first end of a printer cartridge cylinder;

c. a movable second printer cartridge mount attached to the base and positioned opposite to the first mount, the second mount having a wall with a U-shaped saddle configured to directly contact and hold a second end of the printer cartridge cylinder positioned on the second mount, the second mount further comprising an L-shaped frame attached to the wall, the frame having a first plane parallel to the wall and a second plane parallel to the base, the second plane defining a lateral recess, the base and the second mount being attached by a fastener, the fastener passing through the lateral recess of the second plane and through the base, the lateral recess being configured to allow the second mount to move relative to the base and the fastener being configured to control the movement of the second mount; and d. drill hole template attached perpendicular to the first mount, the drill hole template being positioned parallel to the base, the drill hole template defining a drill hole configured to accommodate a cutting device and to create a printer cartridge cutting pattern for the cutting device such that the printer cartridge cylinder can be filled with toner.

15. The device of claim 14, wherein the second mount can be moved toward or away from the first mount to accommodate varying sizes of printer cartridge cylinders.

16. The device of claim 14, wherein the device further comprises a removable collar for insertion into the drill hole to control the depth of a cut of the cutting device.

17. The device of claim 14, wherein the drill hole template overhangs from the first mount.

18. The device of claim 14, further comprising a hole saw configured to be inserted through the drill hole.

* * * * *